US005599550A

United States Patent [19]

Kohlruss et al.

[11] Patent Number: 5,599,550

[45] Date of Patent: Feb. 4, 1997

[54] DISPOSABLE, BIODEGRADABLE, WAX-IMPREGNATED DUST-CLOTH

[76] Inventors: Gregor Kohlruss, Monch-Siegfried-Strasse 11, Borken, D-4280; Hubert Wiesner, Feld 25, Sudlohn 1, D-4286; Ulrich Lersch, Am Briemengarten 5, Pulheim, D-5024, all of Germany

[21] Appl. No.: 267,442

[22] Filed: Jun. 28, 1994

Related U.S. Application Data

[63] Continuation-in-part of Ser. No. 730,950, Sep. 11, 1991, abandoned.

[30] Foreign Application Priority Data

Nov. 18, 1989 [DE] Germany ..... 8913652 U

[51] Int. Cl.[6] ..... A01N 25/34

[52] U.S. Cl. ..... 424/404; 424/403; 424/405; 424/413; 424/416; 514/781; 15/209.1; 523/122

[58] Field of Search ..... 424/402–405, 424/413, 411, 416; 514/789, 781, 787; 536/56, 80; 119/157–159; 523/122; 524/13, 31, 35; 527/103; 162/150, 160–163, 172, 173; 15/209.1, 229.14

[56] References Cited

U.S. PATENT DOCUMENTS

| | | | |
|---|---|---|---|
| 2,618,503 | 11/1952 | Parmet | 15/209 |
| 3,818,533 | 6/1974 | Scheuer | 15/104.9 |
| 4,946,617 | 8/1990 | Sheridan et al. | 252/91 |
| 5,198,292 | 3/1993 | Lerner et al. | 428/290 |

FOREIGN PATENT DOCUMENTS 0225940 6/1987 European Pat. Off. .

*Primary Examiner*—Neil S. Levy
*Attorney, Agent, or Firm*—Furgang & Milde, L.L.P.

[57] ABSTRACT

The invention refers to a disposable dust-cloth. The cloth is part of a dry natural fiber material that is a soft open-pored puffy pulp paper, in colors ranging from light to white, with a filler fraction of less than 10%. The paper is impregnated with a biodegradable wax which has a hardness that prevents its shearing off from the natural fiber material. The wax is a natural wax of plant or animal origin, preferably carnauba or bees waxes, or a synthetic or a chemically modified wax, preferably a paraffin, oxidized polyethylene wax or hydrogenized jojoba oil.

7 Claims, 1 Drawing Sheet

DISPOSABLE, BIODEGRADABLE, WAX-IMPREGNATED DUST-CLOTH

This Application is a cip of U.S. application Ser. No. 07/730,950, filed Sep. 11, 1991, now abandoned.

BACKGROUND OF THE INVENTION

The invention refers to a disposable dust-cloth which is formed of a dry, biodegradable, wax-impregnated natural fiber material.

The German Utility Model Patent No. 85 30 439 describes a gauze filter cleaning fabric consisting of spunlace bonded polyester and impregnated with medium-hard wax. Although this known cleaning fabric shows good mechanical strength and abrasion resistance, it is not fully decomposable due to the materials used for its production, and thus not very environment-friendly.

The U.S. Pat. No. 2,618,803 (Parmer) describes a launderable wax-impregnated dust-cloth. To maintain its integrity during repeated, continuous use and washing, this dust-cloth comprises a washable cloth impregnated with waxes which have a melting point above 100° F. This cloth is also not fully decomposable, and in use it causes static electricity to build up on the surface to be dusted.

The build-up of a static electrical charge results in dust being attracted to the surface to be dusted. Also, the static charge on the cloth itself repels oppositely charged dust particles.

The U.S. Pat. No. 4,904,524 (Yoh) and the International Publication No. WO 87/06470 (Bouchette et al.) disclose "wet wipes" which intentionally leave a liquid residue on a surface to be dusted when used in a normal manner. Although such wet wipes avoid the problem of static electricity, they leave a liquid film on a hard surface when wiped thereon.

The European Published Patent Application No. 0,225,940 (Scamvougeras) discloses a process for producing a wet wipe made of fluff pulp by de-fibering untreated fluff pulp in a hammermill in the presence of a lubricant. The lubricant is a lubricating oil which is liquid at 30° or above and, at a maximum, at 60° or above. As in the case of other wet wipes, this cloth must be stored in a sealed container and it leaves a residue when wiped upon a hard surface.

SUMMARY OF THE INVENTION

The invention aims at providing a dust-cloth of the type described above which, on the one hand, can be produced at low cost and, on the other hand, is fully biodegradable and decomposable when discarded, while offering good mechanical strength and abrasion resistance as well as a good dust absorption capability.

A particular object of the present invention is to provide a dust-cloth which leaves no discernable film or residue when wiped upon a hard surface.

A further particular object of the present invention is to provide a dust-cloth which does not generate static electricity when wiped upon a hard surface.

The above objects, as well as other objects which will become apparent in the discussion that follows, are achieved, according to the present invention, by providing a dust-cloth in which the natural fiber material is made of a soft open-pored puffy pulp paper, in colors ranging from light to white, with a filler fraction of less than 10% and in which the impregnated wax is biodegradable and of a hardness that is just sufficient to prevent its removal (shearing off) from the natural fiber material during normal use.

The preferred pulp material used for the paper is fluffpulp which is characterized by good absorbency and complete biodegradability. The preferred surface weight of the paper is in the range of 35–60 g/m$^2$. The low filler fraction of less than 10% allows the dust-cloth to be open-pored and to have a relatively low deadweight, so that it is scarcely polluting to the environment when discarded. The terms "light and white", as used herein, are intended to describe common pastel colors which show the absorbed dust.

In order to impart good dust absorbency properties to the dust-cloth, the paper is wax-impregnated. A wax content in the range of 2.5 to 50 grams of wax per square meter of paper has proven to be sufficient to impart good dust adhesion characteristics to the dust-cloth without leaving a residue when the cloth is wiped upon a hard surface.

With a dust-cloth according to the present invention, it has been found, surprisingly, that static charges do not build up on a hard surface, such as the surface of furniture, when the cloth is rubbed thereon. Through the use of the waxes described below, a static charge is practically completely avoided so that all the dust on the hard surface can be removed.

Compared to dust-cloths impregnated with a liquid, the invention offers the advantage that the cloth does not dry out and therefore need not be kept in an airproof box.

In order to fulfill the requirements of complete biodegradability, preferably degradable waxes of plant or animal origin are used for the impregnation of the paper used for the impregnation of the paper used for the dust-cloths. Carnauba and bees waxes for instance, are suitable for this purpose. However, synthetic or chemically modified waxes, such as oxidized polyethylene or hydrogenized jojoba oil, can also be used. In order to ensure a hardness which prevents their shearing off from the natural fiber material, the waxes should have melting points ranging from 60° to 85° C. Dipping, spraying with heated liquid wax or the precipitation of the wax from a watery emulsion can be taken as impregnating procedures.

In order to obtain an additional germicide effect, the dust-cloth can be equipped with bactericides, pesticides and/or fungicides. Moreover, provisions can be made to add scents.

The dust-cloth can also be printed or dyed. However, one should maintain a light color in order to indicate the degree of dust saturation to the user of the dust-cloth, by the corresponding darkening with dirt.

On the whole, the dust-cloth according to the invention is an excellent dusting tool and is completely biodegradable.

Due to its impregnation it is able to absorb a large amount of dust, even when dry. Due to low-cost production and due to the fact that it is completely biodegradable, thus creating no disposal problems, and also for reasons of improved hygiene, the user is encouraged and likely to dispose of it after single use.

For a full understanding of the present invention, reference should now be made to the following detailed description of the preferred embodiment of the invention as illustrated in the accompanying drawing.

BRIEF DESCRIPTION OF THE DRAWING

The single FIGURE of the drawing is a top view of a disposable, biodegradable, wax-impregnated dust-cloth according to the present invention.

DESCRIPTION OF THE PREFERRED EMBODIMENT

Figure 1:
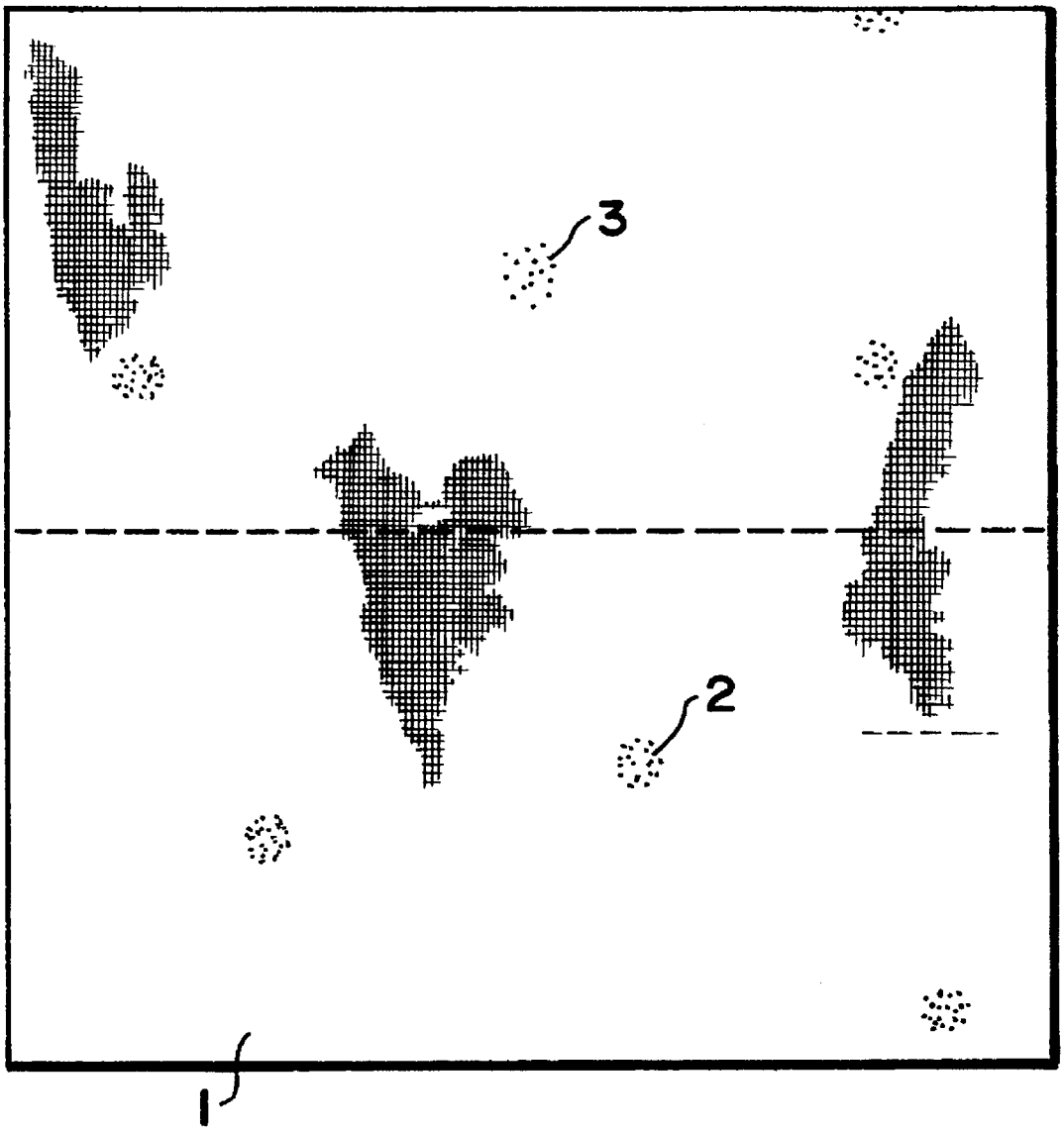

The preferred embodiment of the present invention will now be described with reference to the single FIGURE of the drawing.

The single FIGURE shows a paper dust-cloth 1 with a thin wax layer 2. The dust cloth 1 feels like a soft paper towel, with a slightly waxy surface. It is open-pored and has areas of small puffy "knots" 3. Dust particles agglutinate and, after a certain time of usage, form a distinct, dark area, indicating to the user that the dust-cloth has been used up.

According to the invention, the paper cloth contains no water, lubricant or other moisture which is a liquid at room temperature. Thus, the cloth will leave no discernable film or residue on the surface upon which it is wiped.

Notwithstanding the absence of moisture, the dust-cloth does not cause the build-up of a static electrical charge, when wiped or rubbed upon a hard surface.

There has thus been shown and described a novel disposable, biodegradable wax-impregnated dust cloth which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A fully biodegradable dust-cloth for single use consisting of a natural wax impregnated, absorbent, cellulose, open-pored, fluffy, non-woven felt with a filler fraction of less than 10%, a water content of substantially zero at room temperature, a surface weight of 35–60 g/m$^2$ and a wax content of 25–50 g/m$^2$, said wax having a melting point in the range of 60–85 degrees C. and a hardness sufficient to prevent its removal from the fiber material during use in dusting, thereby to prevent leaving a film of wax or moisture when used to remove dust from a hard surface.

2. The dust-cloth according to claim 1, wherein the pulp material used for the paper is pulp fluff.

3. The dust-cloth according to claim 1, wherein the wax is a natural wax of plant or animal origin, preferably carnauba or bees waxes.

4. The dust-cloth according to claim 1, wherein the wax is a synthetic or chemically modified wax, preferably a paraffin, oxidized polyethylene wax or hydrogenized jojoba oil.

5. The dust-cloth according to claim 1, wherein the dust-cloth has at least one added composition selected from the group consisting of scents, bactericides, fungicides and pesticides.

6. The dust-cloth according to claim 1, wherein in that the dust-cloth is printed in a light color.

7. The dust-cloth according to claim 1, wherein the dust-cloth is dyed.

* * * * *